United States Patent [19]

Landsberger

[11] Patent Number: 4,797,005

[45] Date of Patent: Jan. 10, 1989

[54] DUAL MAGNETIC STIRRING BAR ARRANGEMENT

[76] Inventor: Kurt Landsberger, 103 Harrison St., Verona, N.J. 07044

[21] Appl. No.: 184,366

[22] Filed: Apr. 21, 1988

[51] Int. Cl.[4] ..... B01F 13/08

[52] U.S. Cl. ..... 366/343; 366/273

[58] Field of Search ..... 366/342, 343, 273, 274, 366/279, 241, 242, 244, 325, 326; 416/231 A

[56] References Cited

U.S. PATENT DOCUMENTS

| | | | |
|---|---|---|---|
| 3,245,665 | 4/1966 | Steel | 366/273 |
| 3,749,369 | 7/1973 | Landsberger | 366/273 |

FOREIGN PATENT DOCUMENTS

| | | | |
|---|---|---|---|
| 1026902 | 2/1953 | France | 366/274 |
| 892162 | 3/1962 | United Kingdom | 366/274 |

*Primary Examiner*—Robert W. Jenkins

*Attorney, Agent, or Firm*—Anthony F. Cuoco

[57] ABSTRACT

A dual magnetic stirring bar arrangement is disclosed wherein a pair of elongated substantially cylindrical stirring bars are supported in spaced, substantially parallel relation by a holder. The holder has a curved or arcuate side and a flat side so that the arrangement is adaptable for use within confined or compact spaces in flat or curved bottom containers or the like to provide a greater stirring force than would otherwise be the case.

7 Claims, 1 Drawing Sheet

DUAL MAGNETIC STIRRING BAR ARRANGEMENT

BACKGROUND OF THE INVENTION

Magnetic stirring bars are useful in clinics, medical laboratories, research laboratories and other like facilities wherein it is necessary to stir solutions or specimens. Magnetic stirring bars for the purposes described generally include a permanent magnet having a suitable plastic covering. The bar is inserted in a beaker, flask or other like container containing a solution or specimen to be stirred. The container is placed on a conventional magnetic stirrer whereby the stirrer provides a magnetic field for rotating the stirring bar to stir the solution or specimen.

Magnetic stirrers suitable for the purposes described are marketed by Bel-Art Products, Inc., Pequannock, N.J., and are illustrated in their Catalog 283. Magnetic stirring bars are available in a variety of sizes and shapes depending upon, among other things, the size and shape of the container for the solution to be stirred. Magnetic stirring bars of the type described are likewise marketed by Bel-Art Products, Inc. and disclosed in the aforenoted Catalog 283.

It has been found necessary to provide a magnetic stirring bar arrangement which has greater stirring force in a confined or compact space in lieu of a large stirring bar as would otherwise be necessary so as to provide a more rapid stirring action and to more easily stir or mix relatively viscous materials.

Further, the arrangement contemplated should have the capability of being adaptable for use with either flat or round bottom containers, as the case may be.

Accordingly, the present invention relates to a magnetic stirring bar arrangement which accommodates the aforegoing requirements

SUMMARY OF THE INVENTION

This invention contemplates a dual magnetic stirring bar arrangement including a pair of elongated substantially cylindrical stirring bars. A holder has a pair of holes extending therethrough in substantially parallel spaced relation. Each of the holes receives in force fit relation one of the magnetic stirring bars. The holder is oblong in shape and has a pair of oppositely disposed substantially parallel straight ends and a pair of oppositely disposed substantially parallel sides. One of the sides is straight while the other side is curved so that the holder with the bars disposed in the holes therein is adaptable for use in a flat bottom container or a container having a curved bottom, as the case may be. The arrangement is such that the stirring force of two bars is provided in compact configuration so as to be useful in areas where space is a consideration for precluding the use of a single large bar for providing an equivalent stirring force.

DETAILED DESCRIPTION OF THE INVENTION

Figure 1:
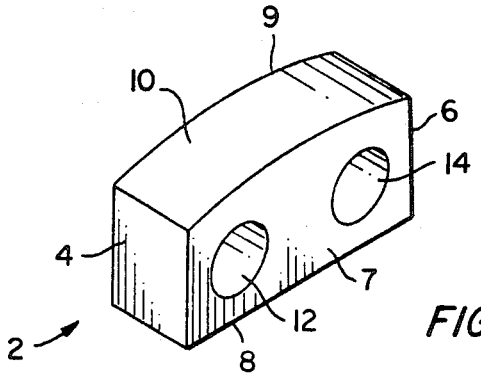
FIG. 1 is a perspective representation of a magnetic stirring bar holder according to the invention.
Figure 2:
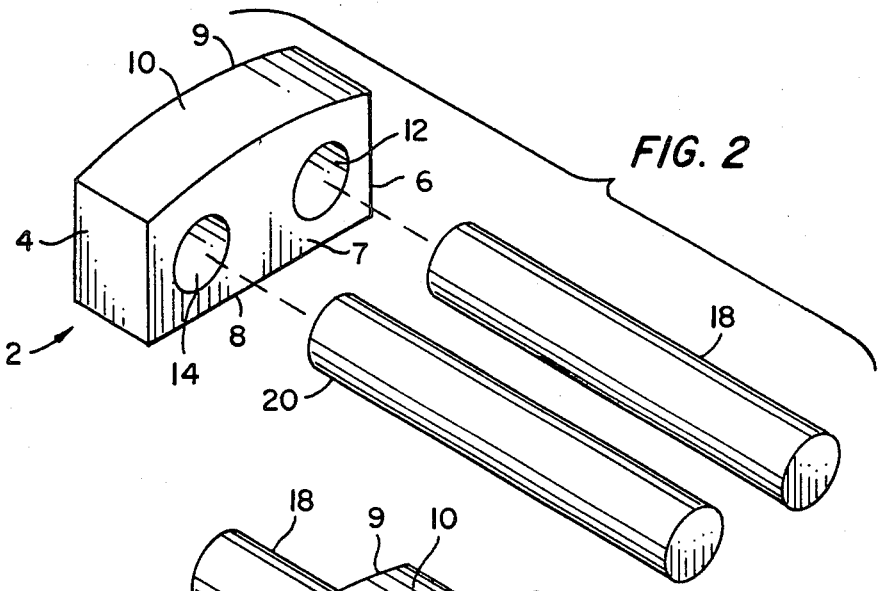
FIG. 2 is a exploded view showing the magnetic stirring bar holder of FIG. 1 and a pair of magnetic stirring bars.

A magnetic stirring bar holder is designated by the numeral 2. Holder 2 is substantially oblong in shape and has oppositely disposed, substantially parallel ends 4 and 6, oppositely disposed substantially parallel sides 8 and 10 and substantially flat and parallel oppositely disposed faces 7 and 9. Side 8 is flat and side 10 is curved or arcuately formed as shown in the drawing. Holes 12 and 14 extend through faces 7 and 9 of holder 2 in longitudinally spaced substantially parallel relation.

Figure 3:
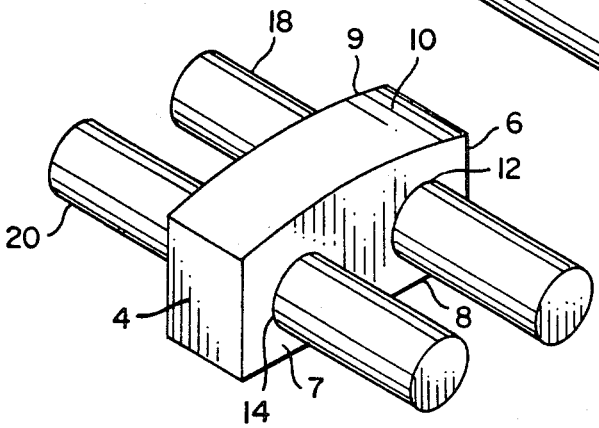
FIG. 3 is a perspective view showing an assembled arrangement including the magnetic stirring bar holder and the pair of magnetic stirring bars.

A pair of elongated, substantially cylindrical stirring bars 18 and 20 are arranged to be force fitted into holes 12 and 14, respectively, which are substantially round, so as to extend through holder 10 as best shown in FIG. 3.

In the preferred embodiment of the invention holder 2 is molded of a suitable material such as Teflon or the like and bars 18 and 20 are conventional permanent magnets having a covering of Teflon or some other suitable plastic material.

It will now be understood that the dual magnetic stirring bar arrangement as shown and described provides a greater magnetic stirring force and is thus useful in confined or compact spaces in place of a single larger bar. The arrangement enhances faster stirring and is particularly useful for stirring or mixing viscous materials. Flat side 8 of holder 2 renders the arrangement useful with containers having flat bottom surfaces or the like and curved or arcuate side 10 renders the arrangement adaptable to curved or round bottom containers, as the case may be.

It will be further understood that the size of holder 2 and the lengths of bars 18 and 20 may be varied to accommodate particular situations.

With the aforegoing description of the invention in mind, reference is made to the claims appended hereto for a definition of the scope of the invention.

What is claimed is:

1. A dual magnetic stirring bar arrangement, comprising:

a substantially oblong holder having a pair of oppositely disposed ends; a pair of oppositely disposed sides and a pair of oppositely disposed faces;

a pair of holes extending through the oppositely disposed faces; and a pair of elongated magnetic stirring bars, each of which is received in force fit relation by a corresponding hole.

2. An arrangement as described by claim 1, wherein: the oppositely disposed ends are substantially parallel and straight.

3. An arrangement as described by claim 1, wherein: the oppositely disposed sides are substantially parallel.

4. An arrangement as described by claim 3, wherein: one of the sides is straight and the other of the sides is arcuate.

5. An arrangement as described by claim 1, wherein: the faces are substantially flat and parallel.

6. An arrangement as described by claim 1, wherein: the holes are substantially round and extend through the faces in longitudinally spaced substantially parallel relation; and the stirring bars are substantially cylindrical.

7. A dual magnetic stirring bar arrangement, comprising:

a substantially oblong holder having a pair of oppositely disposed substantially parallel and straight ends, a pair of oppositely disposed substantially parallel sides, one of which is straight and the other of which is arcuate, and a pair of oppositely disposed substantially parallel faces;

a pair of substantially round holes extending through the faces in longitudinally spaced substantially parallel relation; and a pair of elongated substantially cylindrical bars, each of which is received in force fit relation by a corresponding hole.

* * * * *